US006370913B1

(12) United States Patent
Voeltzel et al.

(10) Patent No.: US 6,370,913 B1
(45) Date of Patent: Apr. 16, 2002

(54) WEDDING RING WITH BREAKING DEVICE

(76) Inventors: Frederic Voeltzel, 44, boulevard de la Republique, F-78400 Chatou (FR); Philippe Voeltzel; Pierre Voeltzel, both of 21, rue Henri Dunant, F-78360 Montesson la Borde (FR); Thierry Dubert, 9, rue Joseph Bara, F-75006 Paris (FR)

( * ) Notice: Subject to any disclaimer, the term of this patent is extended or adjusted under 35 U.S.C. 154(b) by 0 days.

(21) Appl. No.: 09/472,170

(22) Filed: Dec. 27, 1999

Related U.S. Application Data

(63) Continuation-in-part of application No. PCT/FR98/01338, filed on Jun. 24, 1998.

(30) Foreign Application Priority Data

Jun. 27, 1997 (FR) ..... 97 08152

(51) Int. Cl.[7] ..... A44C 19/00
(52) U.S. Cl. ..... 63/15
(58) Field of Search ..... 63/15; 403/2

(56) References Cited

U.S. PATENT DOCUMENTS 643,053 A * 2/1900 Halfmann ..... 63/1.11
1,075,673 A * 10/1913 Segman ..... 63/15.6
1,920,875 A * 8/1933 Miskend ..... 63/15
2,458,645 A 1/1949 Rosenberg et al.
3,599,528 A * 8/1971 Kushnick ..... 411/337
5,657,645 A 8/1997 Abraham
5,765,398 A * 6/1998 Bardisbanyan ..... 63/26

FOREIGN PATENT DOCUMENTS

DE 296 04 402 7/1996

* cited by examiner

*Primary Examiner*—Anthony Knight
*Assistant Examiner*—Andrea Chop
(74) *Attorney, Agent, or Firm*—Browdy and Neimark, P.L.L.C.

(57) ABSTRACT

A device adaptable to any ring, wedding ring or band, wherein the band (wedding ring or the like) is bored with at least a hole right through the whole cross-section. The hole(s) is (are) bored such that the remaining thickness is slight whatever the direction of the hole(s) relative to the band cross-section. The device is applicable in all cases where the calibration of the breaking strength on a band (wedding ring or the like) is useful.

5 Claims, 1 Drawing Sheet

WEDDING RING WITH BREAKING DEVICE

CROSS-REFERENCE TO RELATED APPLICATIONS

This is a continuation-in-part of PCT/FR98/01338 filed Jun. 24, 1998, the contents of which are incorporated herein by reference.

BACKGROUND OF THE INVENTION

The present invention concerns a device which adapts a finger ring, e.g. a wedding ring, or another type of band body, to be easily broken when necessary or desirable. This device enables the breaking of the ring beyond a certain tensile stress threshold applied to the ring.

This objective is achieved by providing at least one hole through the cross-section of the ring, this hole being afterwards plugged by a section of wire adjusted and stabilized.

This device is applicable to all the cases where the gauging of the breaking strength by tensile stress over a ring is useful. It is particularly adapted for preventing serious accidents due to wrenching linked to the wearing of wedding rings, e.g. the ring becoming inadvertently caught by some outside object while the wearer is working.

The present invention is adaptable to all types of finger rings, including wedding rings and other types of band bodies, characterized by the fact that at least one hole is made through the cross-section of the ring (wedding ring or band), e.g. entirely therethrough. The hole (or several holes) is (are) made in such a way as the remaining thickness of the cross-section adjacent the hole is small whatever may be the direction of the hole (or several holes) with respect to the cross-section of the ring. The direction of the hole (or several holes) with respect to the cross-section of the ring is irrelevant or has any direction.

The hole made in the cross-section of the ring is then plugged by a piece of wire of the same dimensions as the hole made in the ring. The section of the wire once set in the hole made through the cross-section of the ring will be afterwards adjusted and stabilized inside the hole itself. The piece of wire may be retained within the hole solely by friction, or it may be held by adhesive or other suitable means; in any event, the adhering force is far less than the inherent tensile strength of the metal itself, so that the ring will break when subjected to a tensile stress above a given or pre-selected value.

DETAILED DESCRIPTION OF THE EMBODIMENT

Figure 1:
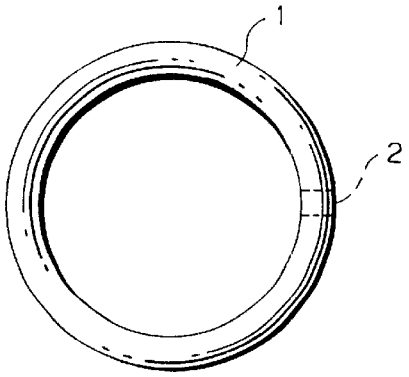
FIGS. 1–2 respectively show front and side elevation views of a ring with a breaking device.
Figure 2:
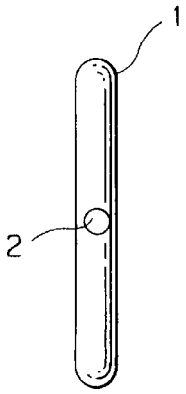
Figure 3:
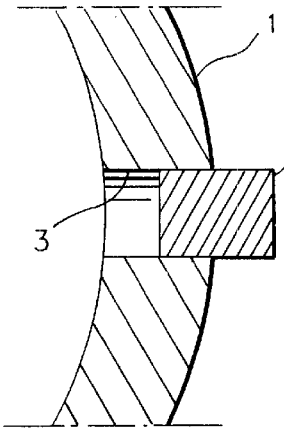
FIGS. 3, 4 and 5 show on an enlarged scale the main parts of the present invention.
Figure 4:
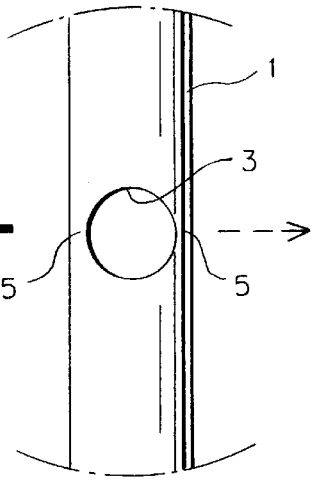
Figure 5:
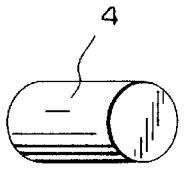

A ring such as a wedding ring 1 has a breaking device 2 comprising at least one hole 3 of any dimension, for example a radial direction hole, and through the cross-section right through the ring 1.

This hole 3 is afterwards plugged by a section of wire 4 of same dimension as the hole 3 made in the ring 1. Once set in the hole 3, this section of wire 4 is adjusted and stabilized.

The hole is made in such a way as the remaining thickness 5 adjacent the hole is small whatever may be the direction of the hole 3 with respect to the cross-section of the ring 1.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed:

1. A ring or band body comprising an annular member having a cross section with a periphery and a thickness dimension, said member being provided with at least one hole extending through the cross section and dimensioned so that portions of said annular member surround said at least one hole; and a section of wire plugging said at least one hole, the section of wire having the same dimensions as said at least one hole and being adjusted and stabilized inside said at least one hole so as not to extend beyond the periphery of the cross section, said at least one hole being of such a size that said portions of said annular member surrounding said at least one hole are dimensioned to enable breaking of the ring or band body beyond a certain tensile stress threshold strained on the ring or band body.

2. The ring or band body according to claim 1, wherein said member is provided with only one said hole.

3. The ring or band body according to claim 1, wherein said at least one hole extends entirely through the cross section of said member.

4. The ring or band body according to claim 1, wherein said ring or band body is a finger ring and said section of wire is dimensioned to allow said finger ring to be worn on a finger when said at least one hole is plugged by said section of wire.

5. The ring or band body according to claim 4, wherein said at least one hole is dimensioned to prevent injury to the finger due to wrenching of said ring.

* * * * *